US005125699A

United States Patent [19]

Dinan

[11] Patent Number: 5,125,699

[45] Date of Patent: Jun. 30, 1992

[54] WINDOW LOCKING ACCESSORY

[76] Inventor: Peggi K. Dinan, 33 Marvin Ave., Uniondale, N.Y. 11553

[21] Appl. No.: 651,943

[22] Filed: Feb. 7, 1991

[51] Int. Cl.[5] ..... E05C 17/04

[52] U.S. Cl. ..... 292/288; 292/DIG. 47

[58] Field of Search ..... 292/288, 258, DIG. 46, 292/262, 338, 339, 305, 306, DIG. 47

[56] References Cited

U.S. PATENT DOCUMENTS

| | | | |
|---|---|---|---|
| 1,005,046 | 10/1911 | Leiner et al. | 292/288 |
| 1,497,039 | 6/1924 | Springborn | 292/292 |
| 1,533,879 | 4/1925 | Macinnes | 292/262 |
| 2,504,367 | 4/1950 | Willink | 292/262 X |
| 2,775,001 | 12/1956 | Baker | 49/449 |
| 3,160,927 | 12/1964 | Busillo | 49/449 |
| 3,232,655 | 2/1966 | Foster | 292/265 |
| 3,938,839 | 2/1976 | Collier | 292/288 X |
| 4,005,889 | 2/1977 | Patrick | 292/262 |
| 4,758,033 | 7/1988 | Wolf | 292/305 |
| 4,792,168 | 12/1988 | Kardosh | 292/339 |
| 4,955,648 | 9/1990 | Miller | 292/288 X |

*Primary Examiner*—Richard E. Moore

*Attorney, Agent, or Firm*—Aquilino & Welsh

[57] ABSTRACT

A generally Z-shaped window locking accessory which allows a window to be opened only a predetermined amount. The window locking accessory functions to secure one window against the other in a contained window frame.

11 Claims, 2 Drawing Sheets

FIG. 1
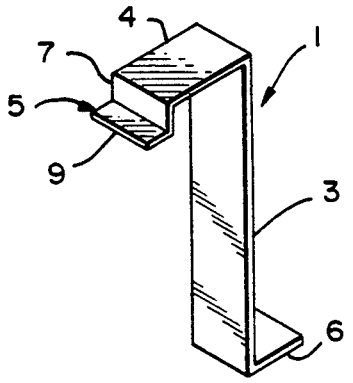
FIG. 2
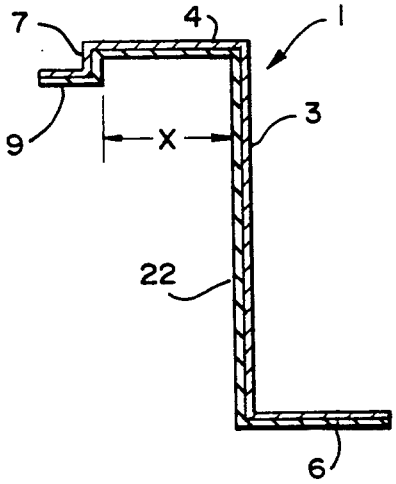
FIG. 3
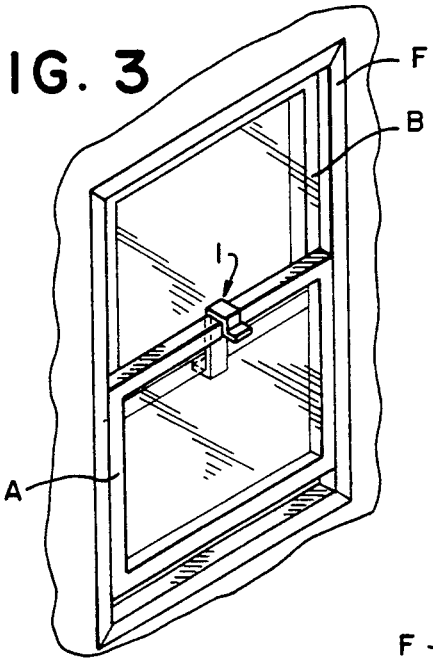
FIG. 5
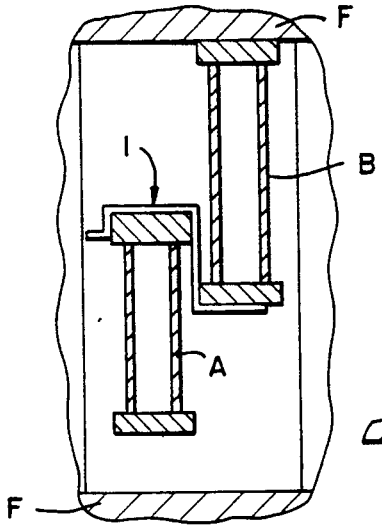
FIG. 4
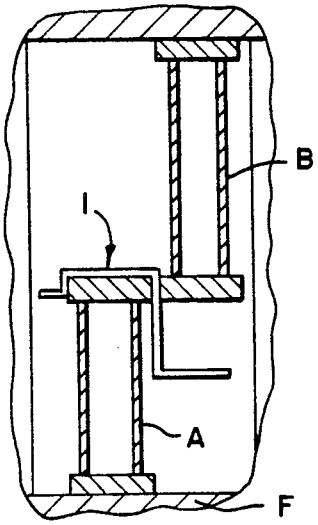
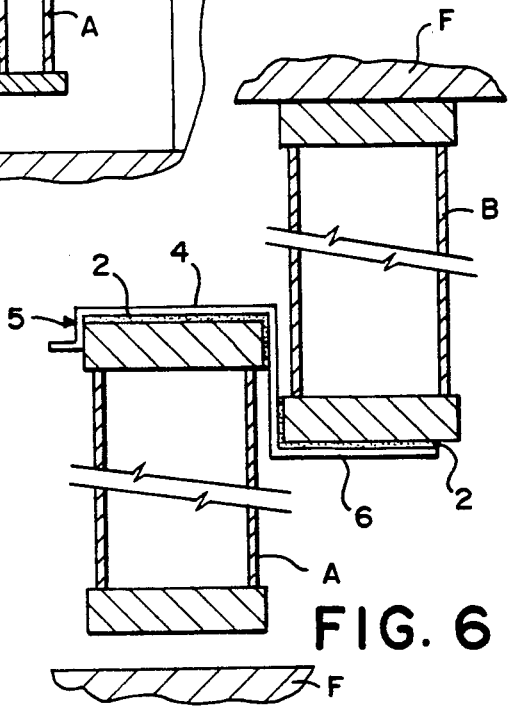
FIG. 6

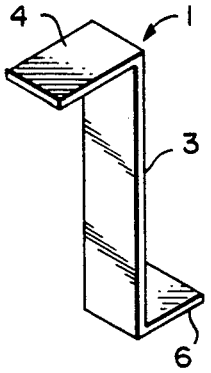
FIG. 7
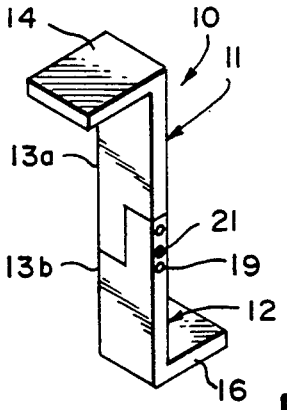
FIG. 8
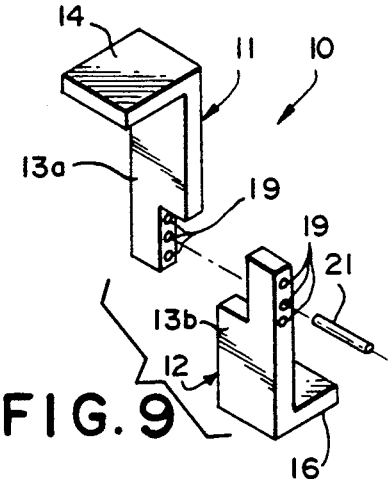
FIG. 9
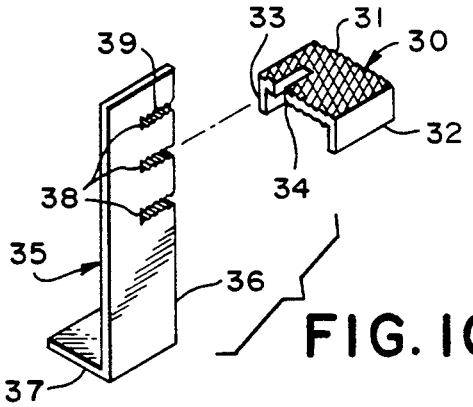
FIG. 10
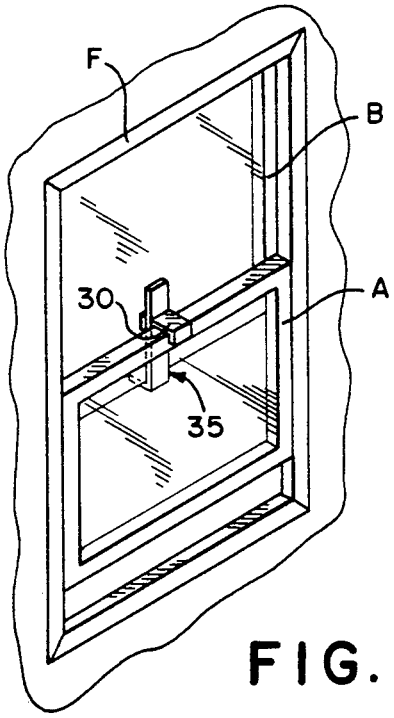
FIG. 11
FIG. 13
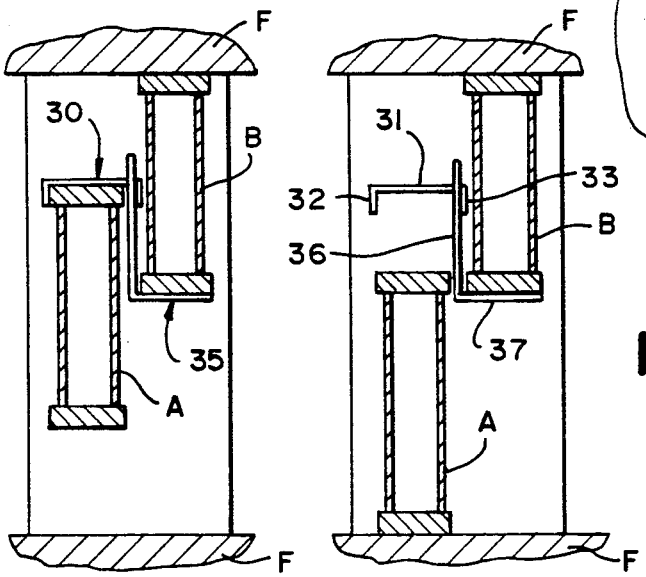
FIG. 12

WINDOW LOCKING ACCESSORY

BACKGROUND OF THE INVENTION

This invention relates to a security device and, more specifically, to a security device for maintaining windows in a partially opened position.

There have been numerous prior attempts to develop window locking assemblies which will allow the window to be opened, but still remain locked, so as to prevent unauthorized entry therethrough. However, these attempts are complicated, include various moving parts and are difficult to install. Examples of such prior art window locking assemblies may be seen in U.S. Pat. Nos. 4,005,889; 4,758,003; 3,232,655 and 2,775,001. While these prior art devices do function, they fail to provide a simple device which only requires seconds to install.

SUMMARY OF THE INVENTION

It is the primary objective of this invention to provide an improved security device for double hung windows which is much simpler to use and manufacture than the prior art devices currently developed.

Another object of the invention is to provide a security device which does not require hand tools for installation.

Still a further objective of this invention is to provide a one-piece windo security device which is aesthetically pleasing in appearance.

Another object of the invention is to provide a window security device which can be installed and removed in a matter of seconds.

These as well as other objectives will become more apparent as the description of the invention proceeds.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of the preferred embodiment;

FIG. 2 is a side view of the preferred embodiment;

FIG. 3 is a front view of the invention installed in a double hung window;

FIG. 4 is a side view of the invention in an inoperative position;

FIG. 5 is a side view of the invention in operation;

FIG. 6 is an enlarged side view of the preferred embodiment while in use;

FIG. 7 is a perspective view of a second embodiment;

FIG. 8 is a perspective view of a third embodiment;

FIG. 9 shows the third embodiment being adjustable in length;

FIG. 10 is a perspective view of a fourth embodiment;

FIG. 11 is a front view of the fourth embodiment installed in a double hung window;

FIG. 12 is a side view of the fourth embodiment positioned between the windows in an inoperative state; and FIG. 13 is a side view of the fourth embodiment positioned between the windows in an operative state.

DETAILED DESCRIPTION OF THE PREFERRED EMBODIMENTS

With reference to the drawings, FIG. 1 shows a perspective view of the one-piece window locking accessory 1. The device includes a rectangular, vertical member 3 connected between an upper planar portion 4 and a lower planar portion 6. The upper planar portion 4 extends perpendicularly from the uppe edge of the vertical member 3 in a first frontward direction and includes a generally L-shaped sash locking tab 5 attached thereto. The locking tab 5 not only serves to securely attach the window locking accessory to the window sash, but also serves as a handle which the user may grasp while installing the window locking accessory 1 between the double hung windows. The first leg 7 of the L-shaped locking tab 5 extends downward while the second leg 9 extends in said first frontward direction. The space between leg 7 and vertical member 3, labelled (x) in FIG. 2, may be variable, depending upon the size of the window sash, in order to fit over and frictionally engage the sash of window A. At the opposite end or lower end of vertical member 3, lower planar portion 6 extends perpendicularly therefrom in a second backward direction a sufficient distance to engage a portion of the sash of window B.

Turning to FIG. 3, a front view of the window locking accessory 1 can be seen in use between windows A and B mounted within a frame F. The front view is looking from inside the house out through the window. The device, when in use, allows the windows to be opened no more than the length of vertical member 3 which can be seen in FIGS. 4 and 5, as the windows are secured within a frame F.

As can be seen in FIGS. 4 and 5, the device is placed in between windows A and B and it is attached to the upper sash of window A by the sash locking tab 5. Once in this position, the window will only open the length of vertical member 3. If either window A or B has been raised or lowered a distance equal to the length of the vertical member 3, the lower planar portion 6 will engage the lower sash of window B and prevent any further movement of window A. Although not shown, it is clear that if an attempt is made to open window B by pushing it down, the window again will only travel the length of vertical member 3 until it hits lower planar portion 6. So, no matter whether one is trying to open window A up or window B down, the maximum amount of travel of either window will be equal to the length of the vertical member 3. The length of vertical member 3 can be variable as long as the amount of travel is not sufficient to permit access through the window frame.

To install the one-piece embodiment, the double hung windows are removable from the window frame or they are of the tilt-in/tilt-out type in which the windows pivot inwardly or outwardly to allow for cleaning or removal. Thus, when window A or B is pivoted or removed, there will be sufficient room to allow the window locking accessory to be placed over the upper sash of window A. Then the window may be pivoted back or installed back into its in use position without lower planar portion 6 interfering.

The window locking assembly is made from a relatively flat, thin material which is sufficiently rigid and strong such that while in use the device can neither be bent nor fractured by repeated forceful attempts of trying to open the window. Various metals, such as steel have been found satisfactory, however the material from which the device is to be made is not be limited to metals.

FIG. 6 is an enlarged side view showing the device in use. The upper and lower planar portions having a felt or foam pad 2 in order to protect the window sashes. The device may also be coated with a plastic resin 22 which serves to protect the window sashes from any damage as shown in FIG. 2.

FIG. 7 shows a second embodiment of the invention which does not include the sash locking tab 5, but still functions in the same manner as described above.

FIGS. 8 and 9 show a third embodiment which is slightly different from the first two embodiments in that it is not integrally formed. The device 10 is made from two generally L-shaped components 11 and 12 which are secured together by a locking means in order to form a vertical member. The first L-shaped component 11 includes a long leg 13*a* and a short leg 14. The second L-shaped component 12 includes a long leg 13*b* and a short leg 16. The feature of being formed from two components allows the window locking accessory 10 to be used on all double hung windows and sliding doors. To install this embodiment, the first component 11 is put into position over the upper sash of a window and then the lower component 12 is slid up into engagement and legs 13*a* and 13*b* are locked together by a locking means. The locking means may be as simple as a plurality of apertures 19 and a pin or pins 21. The pins 21 may be selectively inserted into the apertures in order to adjust the length of the vertical member 13. The two components may also be attached by various other equivalent locking means which allow the two components to slidably engage one another and be locked together by a detent arrangement in order to enable the length of the vertical member 13 to be adjusted.

FIGS. 10–13 show another embodiment which allows the length of the vertical member to be adjusted. This embodiment is also manufactured in two pieces. The first piece is a generally U-shaped sash engaging member 30 having serrated surfaces 34 located on both sides of base 31. The second piece is generally L-shaped member 35 having a long leg 36 with a plurality of slots 38 and a short leg 37. Slots 38 are lined with teeth 39 which function to engage and interlock with the serrations 34 on base 31 to form a locking means. Once the serrations 34 interlock with the teeth 39 in the selected slot 38 separation of the two pieces 30 and 35 becomes extremely difficult.

A front view of the fourth embodiment installed in a double hung window can be seen in FIG. 11. To install the device first piece 30 is placed on the sash of window A and is frictionally engaged therewith. Then second piece 35 is slid between windows A and B and interlocked with the first piece 30. To unlock the two pieces is extremely difficult for an intruder from the outside of the house as they cannot grip the U-shaped member 30 in order to stop it from sliding. They are unable to grip the U-shaped member 30 as leg 33 does not extend past the window sash. Further, even if the device is slid all the way to on side of the window separation would still not be possible as the window frame F would restrict the lateral movement of the L-shaped member 35.

As can be seen in FIGS. 12 and 13, the amount that windows A and B can be opened is adjustable by moving the U-shaped member 30 into engagement with a different slot 38 along the length of the L-shaped member 35.

While various preferred embodiments have been shown and described, it will be understood that there is no intent to limit the invention by such disclosure but, rather, it is intended to cover all modifications and alternate constructions falling within the spirit and scope of the invention as defined in the appended claims.

I claim:

1. A window locking accessory for allowing a window to be opened only a predetermined amount comprising:

a flat rigid metal strip having a rectangular vertical section with an upper and lower end;

an upper planar portion extending perpendicularly from the upper end of said vertical section in a first direction;

a lower planar portion extending perpendicularly from the lower end of said vertical section in a second opposite direction; and a generally L-shaped sash locking tab consisting of a short leg and a long leg, the long leg of the tab extending downwardly from said upper planar portion and short leg of the tab extending in said first direction.

2. The invention of claim 1 wherein said upper planar portion and said lower planar portion are cushioned in order to protect the window sash.

3. The invention of claim 1 wherein the window accessory is covered with a plastic coating.

4. A window locking accessor for allowing a window to be opened only a predetermined amount comprising:

a first generally L-shaped component having a short leg extending in a first direction and a long leg;

a second generally L-shaped component having a short leg extending in a second direction opposite said first direction and a long leg;

a locking means for securely locking the long leg of said first L-shaped component to the long leg of second L-shaped component in order to form a generally Z-shaped configuration; and wherein the long legs of the L-shaped components are secured together to form the intermediate leg of said Z-shaped configuration.

5. The invention of claim 4 wherein said locking means includes a plurality of apertures in the long legs of said first and second L-shaped components and pin means selectively insertable into said apertures.

6. The invention of claim 4 wherein one of said L-shaped components includes an L-shaped sash locking tab extending from its short leg.

7. The invention of claim 4 wherein the short leg of both components is padded in order to protect the window sashes.

8. A window locking accessory for allowing a window to be opened only a predetermined amount comprising:

a first generally U-shaped piece having a pair of legs separated by a base;

a second generally L-shaped piece having a short leg and a long leg; and a locking means for interlocking the long leg of said L-shaped piece directly to the base of the U-shaped piece, such that the base of the U-shaped piece is parallel to said short leg of said L-shaped piece when assembled.

9. The invention of claim 8 wherein the locking means includes serrations on the base and at least one slot lined with teeth on the long leg for engaging said serrations.

10. The invention of claim 8 wherein the long leg has a plurality of slots lined with teeth therein for engaging the base of the U-shaped member.

11. The invention of claim 8 wherein the long leg has a plurality of slots for engaging the base of the U-shaped member.

* * * * *